United States Patent [19]

Hareyama et al.

[11] Patent Number: 4,771,455

[45] Date of Patent: Sep. 13, 1988

[54] SCRAMBLING APPARATUS

[75] Inventors: Nobuo Hareyama, Yokohama; Mitsuo Ohsawa, Chigasaki, both of Japan

[73] Assignee: Sony Corporation, Tokyo, Japan

[21] Appl. No.: 573,919

[22] PCT Filed: Apr. 28, 1983

[86] PCT No.: PCT/JP83/00132

§ 371 Date: Jan. 12, 1984

§ 102(e) Date: Jan. 12, 1984

[87] PCT Pub. No.: WO83/04151

PCT Pub. Date: Nov. 24, 1983

[30] Foreign Application Priority Data

May 17, 1982 [JP] Japan ..... 57-82839

[51] Int. Cl.[4] ..... H04R 1/10

[52] U.S. Cl. ..... 380/6; 380/9; 380/48

[58] Field of Search ..... 179/1.5 S, 1.5 R; 178/22.19; 358/124; 455/27, 28, 29, 30, 115, 116; 370/110.4; 380/6, 8, 9, 28, 35, 48

[56] References Cited

U.S. PATENT DOCUMENTS

| | | | |
|---|---|---|---|
| 2,129,860 | 9/1938 | Mitchell | 455/27 |
| 3,406,344 | 10/1968 | Hopper | 370/110.4 |
| 3,714,622 | 1/1973 | Wilhelmsen | 455/116 |
| 3,921,151 | 11/1975 | Guanella | 179/1.5 S |
| 4,336,554 | 6/1982 | Okada et al. | 358/124 |
| 4,340,906 | 7/1982 | den Toonder et al. | 358/124 |
| 4,392,021 | 7/1983 | Slate | 178/22.19 |
| 4,434,323 | 2/1984 | Levine et al. | 179/1.5 S |

FOREIGN PATENT DOCUMENTS

| | | | |
|---|---|---|---|
| 0087565 | 7/1983 | European Pat. Off. | 358/124 |

*Primary Examiner*—Salvatore Cangialosi

*Attorney, Agent, or Firm*—Hill, Van Santen, Steadman & Simpson

[57] ABSTRACT

The present invention relates to a scrambling apparatus and particularly to a scrambling apparatus in which a scrambling signal is inserted into a main signal in a predetermined period (period of duration during which the main signal is not damaged) of the main signal which makes a dummy signal.

According to an embodiment of the present invention, there is provided a scrambling apparatus which comprises a detecting circuit (36) for detecting that the level of the above main signal becomes lower than a predetermined value and an adding circuit (25) for adding the above main signal and the scrambling signal whereby the supply of the above scrambling signal to the adding circuit (25) is stopped by the output from the detecting circuit (36) to prevent the scrambled signal from being leaked.

The scrambling apparatus of the invention can be applied to an interphone and the like.

4 Claims, 3 Drawing Sheets

SCRAMBLING APPARATUS

TECHNICAL FIELD

The present invention relates to a scrambling apparatus which scrambles an audio signal by using a code and particularly to improve a scrambling apparatus for transmitting a signal series in which an audio signal is scrambled as an ordinary audio signal (of course the signal different from the scrambled audio signal).

BACKGROUND ART

A prior art scrambling apparatus is roughly classified into two types. In one type, the re-arrangement (scrambling) is carried out on a timebase, while in the other type, the re-arrangement is carried out on a frequency axis. In the scrambling apparatus for carrying out the rearrangement on the frequency axis, the signal series is divided into, for example, a plurality of frequency slots and the different frequency conversion is carried out at every slot. Upon re-arranging (descrambling), a frequency conversion reverse to the above frequency conversion is carried out to obtain the signal of the original frequency slot and thus the original signal series is obtained.

In the scrambling apparatus for performing the re-arrangement on the timebase, the signal series is divided into, for example, a plurality of frames. Then, these frames are re-arranged or a plurality of sampling data within the frame is re-arranged within a range of the frame. In the first example where the scrambling is performed on the timebase, the arranging and the rearranging on the timebase are performed as shown in FIG. 1.

In FIG. 1, reference numeral 1 designates a scrambling signal input terminal to which a signal to be scrambled (a scrambling signal) is inputted. The scrambling signal applied to this input terminal 1 is supplied through a trap circuit 2 and a low pass filter 3 to a PCM (pulse code modulation) encoder 4. The scrambling signal is pulse code-modulated by this PCM encoder 4, digitized and then fed to a scrambling circuit 5 in which the arranging on the timebase is performed. The data series thus scrambled is supplied to a composing circuit 6 in which it is added with a synchronizing signal which is supplied through a synchronizing signal input terminal 7. The synchronizing signal has the frequency of, for example, 2 KHz and is coincident with the characteristic of the afore-mentioned trap circuit 2. Namely, the scrambled signal is previously suppressed at its portion corresponding to the synchronizing signal. The data series passed through the composing circuit 6 is converted to an analog signal by a PCM decoder 8 and then supplied through a low pass filter 9 to a transmission path. This transmission path may be of either a wireless type construction or a wire type construction.

The low pass filters 3 and 9 are used to eliminate a noise and low pass filters 10 and 11, which will be mentioned later, are also used similarly. In the receiving system, the signal transmitted through the transmission path is delivered through the low pass filter 10 to a trap circuit 12 and a band pass filter 13. From this band pass filter 13 is derived the synchronizing signal of 2 KHz and this synchronizing signal is supplied to an automatic volume control circuit 14. The control signal therefrom is supplied to a PCM encoder 15 and in addition, the synchronizing signal itself is supplied to the PCM encoder 15. On the other hand, the signal series passed through the trap circuit 12 is PCM-modulated by the PCM encoder 15, which then is re-arranged on the timebase by a descrambling circuit 16. The data series thus re-arranged is converted to an analog signal by a PCM decoder 17 and delivered through the low pass filter 11 from an output terminal 18 to the outside.

By the way, in the above scrambling system, including the example shown in FIG. 1, the signal series to be transmitted can not just hide its appearance of the scrambled signal thoroughly regardless of the strength and weakness of the scrambling property, thereby urging a receiving person to decipher the code of the scrambled signal. As a result, the scrambling system which employs the simple code can be deciphered without difficulty. Accordingly, it becomes a trend to employ the scrambling system which requires an apparatus of high technology and thus the manufacturing cost thereof is inevitably increased. By way of example, the signal series is fourier-transformed at every frame by using an FFT (fast fourier transformer) and the frequency spectrum thereof is changed. After that, an IFFT (inverse fast fourier transformer) is employed to obtain the data series on the timebase which then is transmitted. In the receiving side, this data series is re-arranged by using the same apparatus. Of course, as long as the receiving person is going to decipher the code, any scrambling apparatus inevitably becomes useless after all.

In the second, the use of the scrambled signal sometimes becomes rude to the third person. When in, for example, the reception work and the like an information is exchanged in the presence of a visitor by employing the scrambled signal, if the scrambled signal is picked up by the visitor, the visitor inevitably realizes the scrambling property of the scrambled information when such information is exchanged.

These disadvantages become remarkable particularly when the scrambling system is applied to civilian goods such as an interphone and the like.

DISCLOSURE OF INVENTION

Accordingly, it is an object of the present invention to provide a scrambling apparatus which can obviate the abov defects.

It is another object of the present invention to provide a scrambling apparatus in which a scrambling signal is inserted into a main signal which is used as a dummy signal in a predetermined interval thereof.

It is a further object of the present invention to provide a scrambling apparatus in which when the signal level of a main signal which is used as a dummy signal becomes smaller than a predetermined value, the insertion of the scrambling signal is stopped.

According to an embodiment of the present invention, in a scrambling apparatus in which a scrambling signal is inserted into a main signal in a predetermined period thereof to an extent that the main signal is not so much damaged, the scrambling apparatus comprises a circuit for detecting that the level of the main signal becomes lower than a predetermined level and an adding circuit for adding the main signal and the signal to be scrambled together wherein the supply of the scrambling output to the adding circuit is stopped by the output from the detecting circuit.

Figure 1:
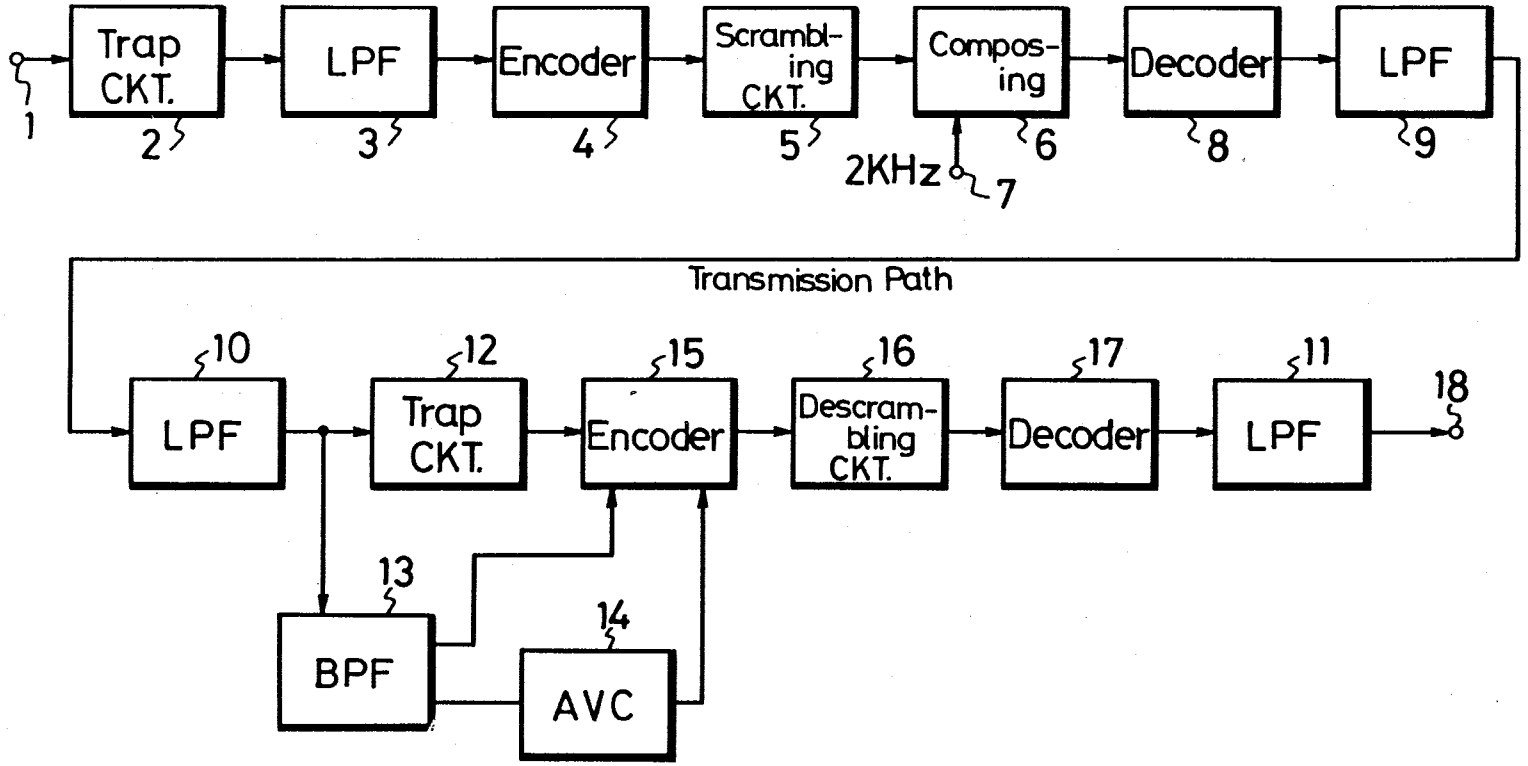
FIG. 1 (PRIOR ART)
FIG. 1 is a block diagram showing an example of a conventional scrambling apparatus.

Reference numeral 21A designates a main signal input terminal, 23 a scrambling signal input terminal, 25 a switching circuit, 26 an adder, 35 a synchronous oscillator and 36 an AGC · Schmitt circuit.

BEST MODE FOR CARRYING OUT THE INVENTION

An embodiment of a scrambling apparatus according to the present invention which is applied to an interphone will hereinafter be described with reference to FIG. 2 and the followings.

Figure 2:
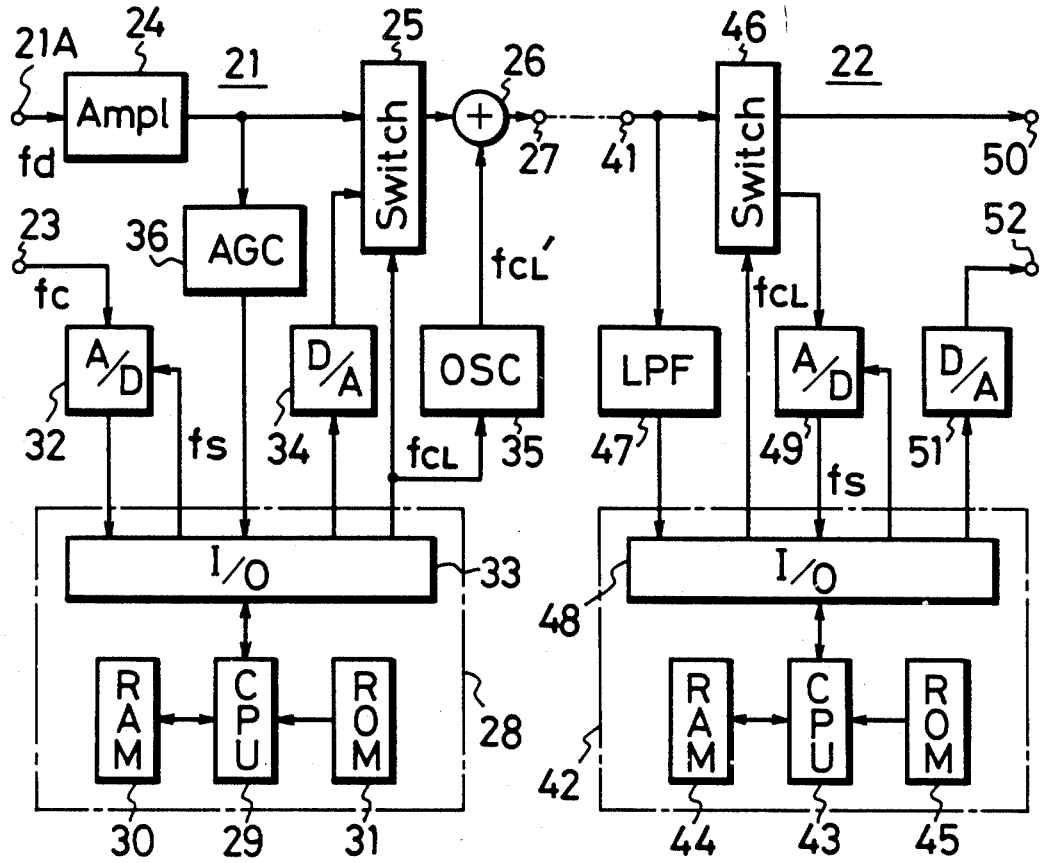
FIG. 2 is a block diagram showing an embodiment of a scrambling apparatus according to the present invention which is applied to an interphone.

FIG. 2 shows a transmitter 21 and a receiver 22 of an interphone in the embodiment of the present invention. In FIG. 2, on the transmitter 21 side, a main signal fd which is used as a dummy signal, for example, a musical signal is supplied to a main signal input terminal 21A. This signal is formed as, for example, shown in FIG. 4C. On the other hand, a scrambling signal fc which is to be scrambled is supplied to a scrambling signal input terminal 23. This scrambling signal fc is of, for example, a conversation signal. The main signal fd is amplified by an amplifier 24 and then delivered through a switching circuit 25 and an adder 26 to an output terminal 27. In the switching circuit 27, the scrambling signal fc, which will be described later, is inserted into the main signal fd, while in the adder 26, a synchronizing signal $f'_{CL}$ is mixed thereto.

The insertion of the scrambling signal fc and the mixing of the synchronizing signal $f'_{CL}$ are controlled by practically a microcomputer 28.

Figure 3:
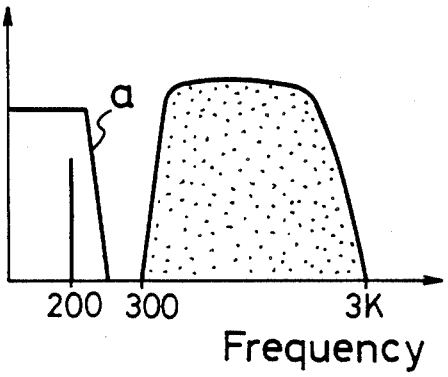
FIG. 3 is a graph showing the frequency spectrum of a main signal in the embodiment shown in FIG. 2.

As is known well, the microcomputer 28 is formed of a CPU (central processing unit) 29, a RAM (random access memory) 30 and so on. In this microcomputer 28, the scrambling signal fc applied to the scrambling signal input terminal 23 is digitized by an A/D converter 32, transferred through an I/O port 33 to the CPU 29 and then written in the RAM 30. Here, the scrambling signal fc has the transmission spectrum ranging from 300 Hz to 3 KHz as shown by scattered points in FIG. 3. Therefore, the sampling frequency of this A/D converter 32 is selected as 6 KHz. The sampling signal fs therefor is supplied from the CPU 29 to the A/D converter 32 through the I/O port 33.

The scrambling signal fc is sequentially divided into frames of, for example, 10 m sec and the data of every frame is written in the RAM 30 as one unit. Accordingly, the data of one unit is formed of, for example, 60 sampling words.

Figure 4A:
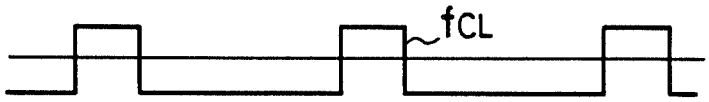
FIGS. 4A-and 5A-5E are respectively timing charts used to explain the embodiment shown in FIG. 2.
Figure 4B:
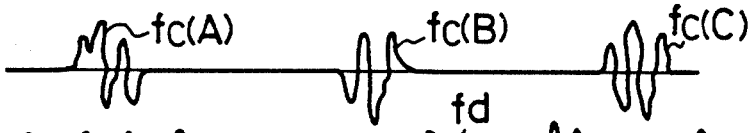
Figure 4C:
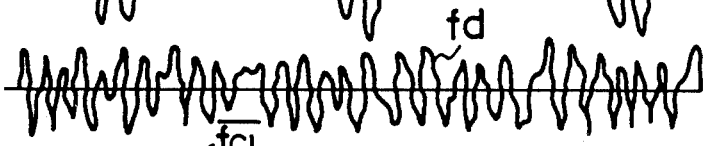
Figure 4D:
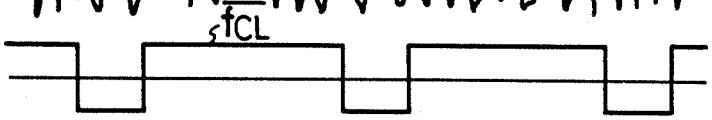
Figure 4E:
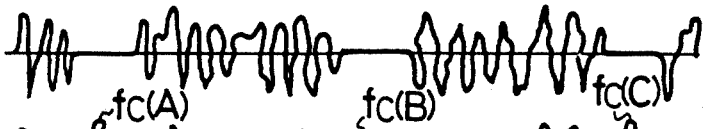
Figure 4F:
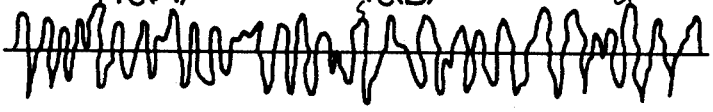

The data written in the RAM 30 is supplied each one frame data through the I/O port 33 and a D/A converter 34 to the switching circuit 25. This transfer of data is carried out at each interval of, for example, 60 m sec. And, a switching pulse $f_{CL}$ synchronized with this interval is supplied from the CPU 29 to the switching circuit 25 through the I/O port 33. In this case, the phase relation between the scrambling signal fc delivered from the D/A converter 34 and the switching pulse $f_{CL}$ is a synchronized relation as shown in FIGS. 4A and 4B. When an inverted pulse $F_{CL}$ the switching pulse $f_{CL}$ is at high level, the main signal fd is passed through the switching circuit 25 as shown in FIG. 4E, so that from the switching circuit 25 such a signal in which the scrambling signal fc is inserted repeatedly into the main signal fd at a predetermined period as shown in FIG. 4F is delivered.

The sampling pulse $f_{CL}$ from the microcomputer 28 is supplied to a synchronous oscillator 35 which forms a synchronizing signal (the sine wave signal) $f'_{CL}$ synchronized with the sampling pulse $f_{CL}$. This synchronizing signal $f'_{CL}$ is superimposed upon the transmission signal from the switching circuit 25 and then delivered to the output terminal 27.

In the above case, the insertion interval of the scrambling signal is selected to be 10 m sec and the other interval is selected to be 50 m sec (60-10). However, when a signal such as a musical signal in which similar signals are continuous is scrambled, it is desired that the interval into which the scrambling signal is inserted is selected as short as, for example, 5 m sec.

Figure 5A:
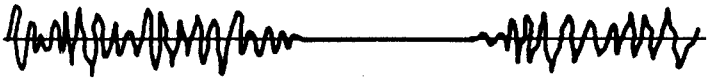
Figure 5B:
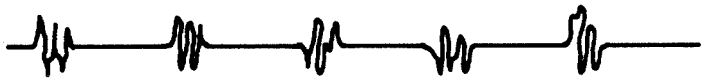
Figure 5C:
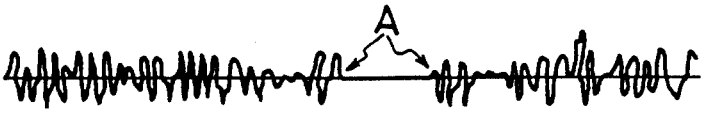
Figure 5D:
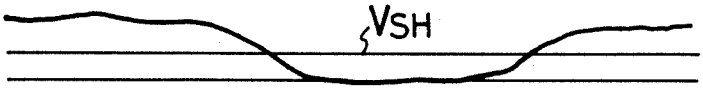
Figure 5E:
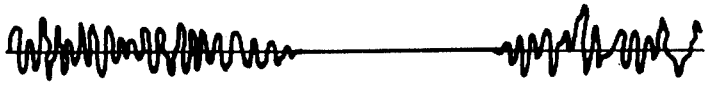

Moreover, in this embodiment, the main signal fd amplified by the amplifier 24 is supplied to an AGC ·Schmitt circuit 36. When the level of the amplified main signal fd is lower than a predetermined level (shown by, for example, $V_{SH}$ in FIG. 5D), the AGC ·Schmitt circuit 36 generates a detecting signal and supplies the same to the CPU 29 through the I/O port 33. In the AGC Schmitt circuit 36, a predetermined recovery time is given to the AGC operation. When the detecting signal is transferred from the AGC ·Schmitt circuit 36 to the CPU 29 side, the CPU judges that the main signal fd becomes to have therein a silence portion and inhibits the frame data of the scrambling signal fc from being transferred to the switching circuit 25 during this period. When the level of the main signal fd becomes small as, for example, shown in FIG. 5A, if the scrambling signal fc shown in FIG. 5B is inserted during the portion in which the level of the main signal is small, there is such a fear that as shown by A in FIG. 5C only the scrambling signal is floated and the scrambling information may be known. Therefore, in this case, the CPU 29 inhibits the portion of the scrambling signal shown by A in FIG. 5C from being inserted but the transmission signal as shown in FIG. 5E is obtained.

The transmission signal thus formed is supplied through a signal line shown by a one-dot chain line to an input terminal 41 of the receiver 22. Of course, it is possible that the transmission is carried out by using not only the signal line but also wireless system after FM or AM process.

The control for the re-arrangement of the signal series in the receiver 22 is carried out by a microcomputer 42. In the same way as in the above-mentioned microcomputer 28 at the transmitter 21 side, this microcomputer 42, of course, is formed of a CPU 43, a RAM 44, a ROM 45 and the like.

The signal series supplied to the input terminal 41 is supplied to a switching circuit 46 and a low pass filter 47, respectively. The low pass filter 47 has a characteristic shown by a in FIG. 3 and from this low pass filter 47 derived is the above synchronizing signal of 200 Hz. This synchronizing signal is supplied through an I/O port 48 to the CPU 43. In the CPU 43, on the basis of this synchronizing signal, the switching pulse $f_{CL}$ is formed and supplied to the switching circuit 46. This switching pulse $f_{CL}$ allows the signal series to be supplied to an A/D converter 49 at high level timing thereof, while this switching pulse $f_{CL}$ allows the signal series to be delivered to a main signal output terminal 50 at low level timing thereof. Thus, to the main signal output terminal 50 is supplied a signal which corresponds to FIG. 4E. In view of the phase of the switching pulse $f_{CL}$, to the A/D converter 49 is supplied the scrambled signal fc shown in FIG. 4B. After being converted to the digital signal, this signal is transferred through the I/O port 48 to the CPU 43. In this case, from the CPU 43, the sampling pulse fs is supplied through the I/O port 48 to the A/D converter 49.

From the A/D converter 49 is sequentially transmitted the frame data at each period of the switching pulse $f_{CL}$. This frame data is written through the CPU 43 in the RAM 44. In the RAM 44, the frame data is sequentially stored and this frame data, which is under the condition that a series of frame data are connected together, is supplied through the I/O port 48 to a D/A converter 51 in which it is converted to the analog signal and then supplied to a scrambled signal output terminal 52. As a result, at the scrambled signal output terminal 52 is is developed the scrambled signal.

In such interphone, from the output terminal 27 of the transmitter 21 is transmitted the signal series as shown in FIG. 4F. In the transmission of this signal, the main signal which serves as the dummy signal is first transmitted during the period of 50 msec amount and then the scrambled signal is transmitted during the period of 10 msec . The third person, who picks up this signal series, listens in the main signal which shares almost all of the signal series. If the main signal is the musical signal, the third person accepts it as a music, while if it is the conversation signal, the third person accepts it as the conversation signal so that the scrambled signal contained therein is never noticed. Accordingly, the receiver is never urged to decipher the code of the signal series and the visitors and so on who hear such signal series never feel disagreeable.

In the reception work, various modes of the reception work can be considered in which audio signals of plurality of kinds representative of the kinds of visitors and business are stored in the ROM and by only the operation of buttons one of them can automatically be transmitted to the side of the receiver as the scrambled signal, etc..

In this embodiment, the silence portion of the main signal fd and the peripheral portion thereof having small level are detected and at that time, the frame data of the scrambled signal fc is inhibited from being transmitted. Therefore, even when the level of the main signal fd becomes small and ineffective as the dummy signal, there is caused no problem. In the RAM 44 at the receiver 22, the writing is stopped until the frame data of the scrambled signal is newly transmitted thereto. It is not until the level of the main signal fd becomes large and the frame data of the scrambled signal fc is transferred thereto that the address of the RAM 44 is incremented. Thus, there is no problem in view of the data pool.

Figure 4G:
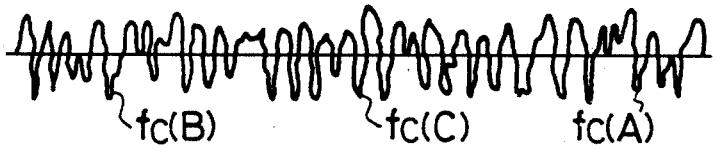

While in the above embodiment the scrambling signal is simply divided at every frame and sequentially inserted into the main signal, it is possible that each frame of the scrambling signal is re-arranged on the timebase so as to strengthen the scrambling property more. FIG. 4G shows the signal series re-arranged as above in which the scrambled signals A, B and C shown in FIG. 4E are re-arranged on the timebase as in B, C and A in this order. In like manner, other method of re-arranging on the timebase may be employed or a method of re-arranging on the frequency axis may be employed.

In the above embodiment, since the frame of the scrambling signal is inserted into the main signal as it is, the efficiency regarding the transmission of the scrambled signal becomes low. Therefore, it is possible that in the transmitter 21 side the scrambling signal is timebase-compressed and then re-arranged, while in the receiver 22 side the scrambled signal is re-arranged and then timebaseexpanded. If so, the transmission efficiency of 1:1 can be obtained.

As set forth above, according to this invention, the scrambling signal is inserted into the interval of the main signal under the condition that the main signal which makes the dummy signal is not s much damaged. At the same time, when the level of the main signal becomes small and the dummy effect thereof disappears, the insertion of the scrambling signal is stopped. Consequently, even when the main signal contains therein the silence portion, the third person who picks up the signal series being transmitted never regards it as the scrambled signal series. As a result, the third person is never urged to decipher the code of the scrambled signal series and never feels unpleasant.

The present invention is not limited to the above embodiment but can take various modifications without departing from the subject matter thereof.

We claim:

1. A scrambling apparatus in which portions of a signal (fc) to be scrambled are inserted at predetermined intervals into an intelligence signal (fd), said signal (fc) to be scrambled and said intelligence signal being in the form of analog signals, said apparatus comprising an A/D converter (32) for analog-to-digital (A/D) converting said signal (fc) to be scrambled, a synchronizing signal source producing a synchronizing signal ($f_{cl}$), a D/A converter (34) for digital-to-analog (D/A) converting the output data from said A/D converter at every said predetermined interval in synchronism with said synchronizing signal ($f_{cl}$), an adding circuit (26) supplied with said intelligence signal (fd) and the analog output signal from said D/A converter, and detecting means for detecting when said intelligence signal (fd) falls below a predetermined level and for preventing insertion of said signal (fc) to be scrambled into said intelligence signal (fd) while said intelligence signal (fd) remains below said level.

2. A scrambling apparatus according to claim 1 wherein data provided by A/D-converting said signal (fc) to be scrambled are stored in a random access memory 30, and upon reading said stored data a portion of said signal (fc) to be scrambled corresponding to a predeterminedd interval and to said synchronizing $f_{cl}$ is D/A-converted.

3. A scrambling apparatus according to claim 2 wherein said data provided by A/D-converting said signal (fc) to be scrambled are re-arranged on a timebase.

4. A scrambling apparatus according to claim 1 wherein said adding circuit (26) is supplied with said signal (fd), said signal (fc) to be scrambled and said sychronizing signal $f_{cl}$ of a frequency corresponding to the frequency of said predetermined intervals.

* * * * *